US005592047A

United States Patent [19]

Park et al.

[11] Patent Number: 5,592,047

[45] Date of Patent: Jan. 7, 1997

[54] FLAT GLOW DISCHARGE LAMP

[75] Inventors: Duk-il Park, Seoul; Sang-mook Kim, Kyunggi-do, both of Rep. of Korea

[73] Assignee: Samsung Display Devices Co., Ltd., Kyunggi-do, Rep. of Korea

[21] Appl. No.: 380,964

[22] Filed: Jan. 30, 1995

[30] Foreign Application Priority Data

Oct. 25, 1994 [KR] Rep. of Korea ..... 94-27880 U

[51] Int. Cl.[6] ..... H01J 65/04; H01J 61/92

[52] U.S. Cl. ..... 313/484; 313/631; 313/607; 313/234; 313/491

[58] Field of Search ..... 313/483, 484, 313/485, 491, 493, 517, 631, 607, 234, 246; 359/48; 315/169.4

[56] References Cited

U.S. PATENT DOCUMENTS 4,851,734 7/1989 Hamai et al. ..... 313/485
5,070,273 12/1991 van den Bogert et al. ..... 313/493
5,343,114 8/1994 Beneking et al. ..... 313/485
5,343,115 8/1994 Anandan et al. ..... 313/491

FOREIGN PATENT DOCUMENTS 61-269848 11/1986 Japan ..... H01J 61/72

*Primary Examiner*—Michael Horabik
*Assistant Examiner*—Michael Day
*Attorney, Agent, or Firm*—Christie, Parker & Hale, LLP

[57] ABSTRACT

A flat glow discharge lamp includes a discharge tube having two opposing flat faces and a first and second plurality of long electrodes disposed on respective opposing flat faces, wherein one of the pluralities of long electrodes is composed of a transparent conductive material. The discharge lamp includes a fluorescent layer disposed on the inner surface of the discharge tube, and either rare gases, such as argon, or low-pressure mercury vapor. The first and second plurality of long electrodes provides for a homogeneous discharge over the face of the discharge lamp.

7 Claims, 1 Drawing Sheet

FLAT GLOW DISCHARGE LAMP

BACKGROUND OF THE INVENTION

A. Field of the Invention

The present invention relates to a flat lighting device which emits light uniformly throughout the flat lamp surface.

B. Description of the Prior Art

The LCD (Liquid Crystal Display), for example, is not a luminant and, therefore, requires a separate light source to visualize the characters and/or picture displayed by the LCD. Thus a flat lighting device is adopted as a back light for the LCD panel generally.

FIG. 2 shows a flat electric discharge lamp, a kind of flat lighting device 21, disclosed in Japanese Patent Laid-open Sho 61-269848. This discharge lamp 21 of non-circular cross section has a thin and wide discharge tube 22. A fluorescent layer is formed on the inner surface of discharge tube 22, and electrodes 24 are disposed at both sides within discharge tube 22. Magnets 25 arranged on discharge tube 22 form magnetic fields M.

When power is supplied to electrodes 24, electrons discharged between electrodes 24 moves within the electric field formed by the voltage applied to electrodes 24 and magnetic field M formed by magnets 25. Because this lamp 21 needs a high-frequency power source and magnets 25, the lamp 21 has a problem of sophisticated structure. Also because electrodes 24 are subject to collision with the electrons discharged within discharge tube 22 and exhausted thereby, the service life of the discharge lamp is shortened.

SUMMARY OF THE INVENTION

The present invention overcomes the problems and disadvantages of the conventional art by providing a flat lighting device which emits light uniformly throughout the flat lamp surface.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, the flat lighting device of the invention comprises a discharge tube having at least one flat surface. A plurality of long parallel electrodes are disposed on the flat surface of the discharge tube. When power is supplied to the electrodes, electrical discharge occurs among the adjacent electrodes throughout the length of the electrodes.

Details of the present invention will be set forth in the description which follows with reference to the accompanying drawings. The drawings, which are incorporated in and constitute a part of this specification, illustrate preferred embodiments of the invention and together with the description, serve to explain the principles of the invention.

DESCRIPTION OF THE PREFERRED EMBODIMENT

Figure 1:
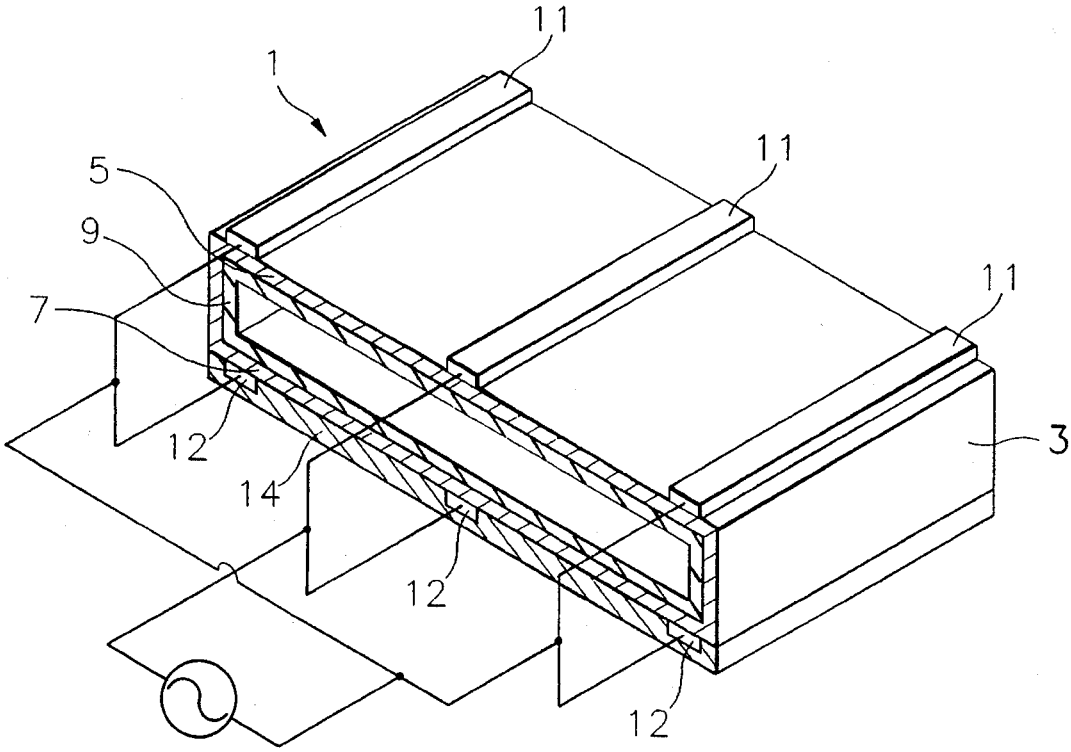
FIG. 1 is a partially cut away diagrammatic perspective view showing a flat lighting device according to an embodiment of the present invention.
Figure 2:
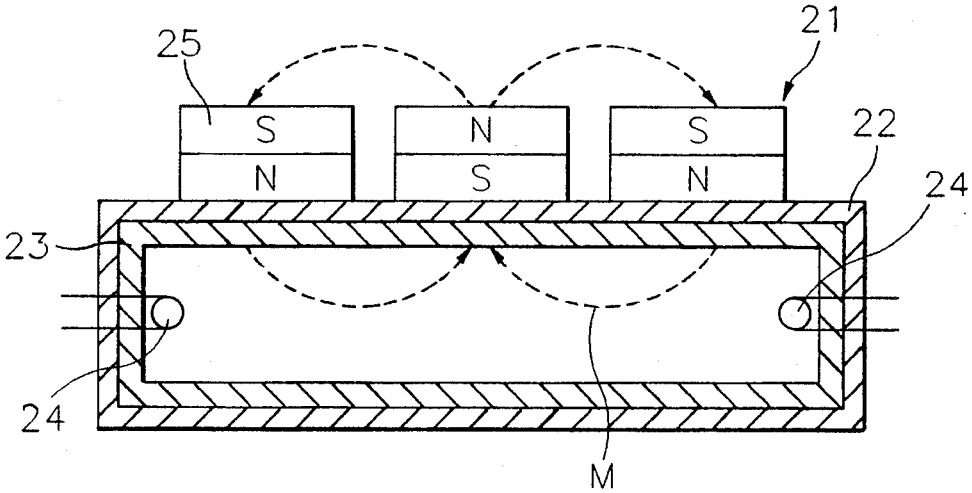
FIG. 2 (Prior Art)
FIG. 2 is a cross sectional diagrammatic view showing a prior art flat discharge lamp.

Reference will now be made in detail to preferred embodiments of the present invention, an example of which is illustrated in FIG. 1.

A flat lighting device 1 has a discharge tube 3. Discharge tube 3 has at least one flat surface, and, in the embodiment illustrated in FIG. 1, there are upper and lower surfaces 5 and 7. Discharge tube 3 is sealed, a fluorescent layer 9 is formed on the inner surface of discharge tube 3, and discharge tube 3 is filled up with rare gases such as argon, for example, or gaseous mercury.

A plurality of long electrodes 11 and 12 parallel to each other are disposed on upper and lower surfaces 5 and 7 of discharge tube 3 along the length thereof. It is preferable to make electrodes 11 and 12 in the shape of thin strips having a predetermined width. Shown in FIG. 1 are three electrodes 11 and 12 on the upper and lower faces 5 and 7, respectively. However the number of electrodes can be determined according to the width of discharge tube 3. Also it is possible to dispose the electrodes on only one of upper and lower faces 5 and 7.

As shown in FIG. 1, AC voltage sources are connected to adjacent electrodes. When power is supplied to the electrodes, an electrical discharge occurs among the adjacent electrodes throughout the lengths of the electrodes. Here, the electric field by the electric potential applied is formed across the electrodes, and the electrons discharged move along the electric field. Accordingly the electrons discharged throughout the lengths of the electrodes move along the electric field across the electrodes, and, as a result, the emission of light by the discharge is uniform throughout the surface of the discharge tube 1.

In case of a normal back light used in an LCD, a reflective layer of nonconductive material is provided below the lower surface 7 of the discharge tube 1. It is preferable to have some or all of the electrodes 11 and 12 made of transparent materials in order that these electrodes may not obstruct the light.

As explained and illustrated above, because electrodes 11 and 12 are disposed from discharge tube 3 according to the present invention, the electrodes are not subject to exhaust, and, thus, the service life of the flat lighting device is long.

Also because the thickness of discharge tube 3 can be minimized, the gas can remain through the electrical discharge, and the thickness of the flat lighting device itself can be reduced. Also due to the simple structure of the flat lighting device, the productivity can be improved and the manufacturing cost can be reduced.

Other embodiments of the invention will be apparent to one skilled in the art from consideration of the specification and practice of the invention disclosed herein. It is intended that the specification and examples be considered as exemplary only, with the true scope and spirit of the invention being indicated by the following claims.

What is claimed is:

1. A flat lighting device comprising:

a discharge tube having opposing first and second flat faces and two side faces disposed between said first and second flat faces, the first and second faces each comprising a larger surface area than the surface area of each of the side faces, said discharge tube being filled with rare gases or gaseous mercury; and a plurality of elongated parallel electrodes disposed on the first flat face of the discharge tube, and another plurality of elongated parallel electrodes disposed on the second flat face of the discharge tube, wherein electric discharge occurs between adjacent said electrodes throughout the length of the electrodes when electricity is applied to the electrodes.

2. The device as claimed in claim 1, wherein the electrodes comprise thin strips having a predetermined width.

3. The device as claimed in claim 2 wherein at least one of the electrodes is made of transparent materials.

4. The device as claimed in claim 1 wherein the electrodes are disposed along a length of the discharge tube.

5. The device as claimed in claim 1 wherein a fluorescent layer is formed on an inner surface of the discharge tube.

6. The device as claimed in claim 1 wherein a reflective layer made of nonconductive material is provided at said second flat face of the discharge tube.

7. The device as claimed in claim 1 wherein each of the electrodes have substantially the same size and are located at substantially equal distances from each other.

* * * * *